United States Patent [19]

Gargiani

[11] Patent Number: 5,070,711

[45] Date of Patent: Dec. 10, 1991

[54] METHOD AND DEVICE FOR NEEDLE SELECTION IN A CIRCULAR KNITTING MACHINE, PARTICULARLY FOR SELECTION NEEDLE BY NEEDLE

[75] Inventor: Pierangelo Gargiani, Scandicci, Italy

[73] Assignee: Savio S.p.A., Pordenone, Italy

[21] Appl. No.: 461,383

[22] Filed: Jan. 5, 1990

[30] Foreign Application Priority Data

Jan. 18, 1989 [IT] Italy ..... 9314 A/89

[51] Int. Cl.[5] ..... D04B 9/26; D04B 15/66

[52] U.S. Cl. ..... 66/219

[58] Field of Search ..... 66/219, 220

[56] References Cited

U.S. PATENT DOCUMENTS

| | | | |
|---|---|---|---|
| 3,667,254 | 6/1972 | Paepke | 66/219 X |
| 3,733,855 | 5/1973 | Bliss-Hill et al. | 66/219 |
| 3,855,819 | 12/1974 | Sawazaki | 66/50 R |
| 4,196,599 | 4/1980 | Güell | 66/220 X |
| 4,716,743 | 1/1988 | Caselli | 66/219 |

FOREIGN PATENT DOCUMENTS

| | | | |
|---|---|---|---|
| 2305427 | 8/1974 | Fed. Rep. of Germany | 66/219 |
| 2445291 | 4/1976 | Fed. Rep. of Germany | 66/219 |
| 1257491 | 12/1971 | United Kingdom | 66/219 |
| 2058848 | 4/1981 | United Kingdom | 66/220 |
| 2112822 | 7/1983 | United Kingdom | 66/219 |

*Primary Examiner*—William A. Cuchlinski, Jr.
*Assistant Examiner*—John J. Calvert
*Attorney, Agent, or Firm*—Hedman, Gibson, Costigan & Hoare

[57] ABSTRACT

This device relates to a circular knitting machine in which the inactivation or activation of a vertical jack standing below each needle is controlled by a horizontal jack. The horizontal jack is located in a radial position relative to a cylinder within a ring structure. This ring structure surrounds and is rigid with the machine cylinder. It contains, in a number equal to the number of needles, radial grooves. The horizontal jacks slide radially in the grooves as well as horizontally. They are selected by electromagnetic retention devices with which each jack is provided and which are mounted on the ring structure. When the devices are energized, they retain the horizontal jacks in their outer position to activate the corresponding needles. When they are not energized, the electromagnetic devices allow the horizontal jacks to return to their inner position by a thrust spring, to leave the corresponding needles in a rest postion.

8 Claims, 1 Drawing Sheet

2
19
20
1
21
24
18
5
4
17
17'
3
10
14
16
15
11
13
10
27
28
6
12
9
7
23
8
26
22
25

10
14'
11
15'

METHOD AND DEVICE FOR NEEDLE SELECTION IN A CIRCULAR KNITTING MACHINE, PARTICULARLY FOR SELECTION NEEDLE BY NEEDLE

This invention relates to circular knitting machines and in particular to the selection of needles in such machines for the purpose of producing patterned knitwork, such as hosiery. It provides a device and method for selecting those needles which are to pick up the yarn from the feeds to form patterned hosiery articles.

Circular knitting machines are known to consist essentially of one or more cylinders 1 comprising grooves in their outer cylindrical surface.

The grooves represent the guides for the needles 2 which during their travel form the stitch loops in cooperation with the sinkers.

The number of grooves is equal to the number of needles 2 which slide reciprocatingly in them.

Generally, the number of grooves and needles is between 200 and 400 per cylinder.

The needles operate with reciprocating movement between a maximum position and a minimum position into which they are moved by knitting cams.

The cylinder is rotated and with it are rotated the needles which during their reciprocating movement are fed with yarn at their highest point of travel when in a fixed position.

To produce hosiery articles generally only part of the available needles are used at the same time and in the same manner, except for the plain knitwork parts, for which all the needles are operated between their maximum and minimum level, all being fed with yarn at each knitting course, and all being moved in the same manner.

When the machine is not producing plain knitwork, in order to produce other types of knitwork (such as mesh or patterned knitwork) some needles are required to produce stitch loops while others have to be raised to an intermediate level to take up yarn without clearing the previous stitch in order to form a tuck stitch, or have to be raised with a certain delay so that they do not pick up the yarn fed into a certain angular position and therefore do not form new loops with it. In other words a needle selection has to be made. This means that for each revolution of the cylinder a certain number of needles must undergo a certain travel and a certain number of other needles must undergo a certain different travel or indeed undergo no travel.

This selection is made by the jacks 3 which slide in the same grooves as the needles lying above them, and which move these latter to a higher level in order to seize the yarn. When the jacks have moved the needle into its working position they withdraw from the needle butt and return downwards. If the needle, after completing its task of seizing the yarn and forming the stitch loop and therefore being at its minimum level, is not required to pick up a further yarn from another feed it remains at this level because its control jack remains in its lower rest position.

The jack 3 has a special shape which corresponds to a precise function.

Figure 1:
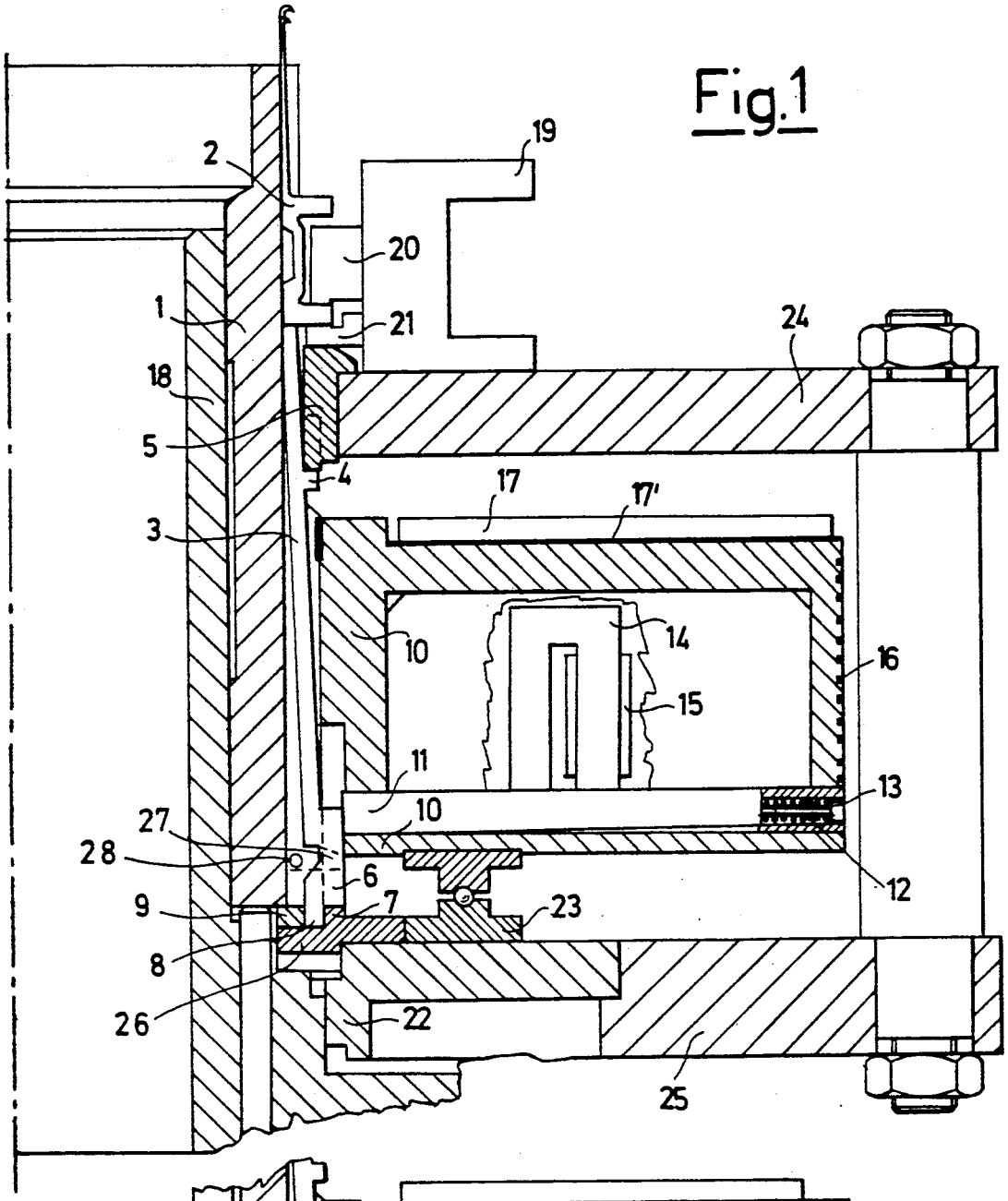
FIG. 1 is a radial section, through the needle cylinder of the needle selection device.

Although not shown on the drawings, it is slightly curved, or bowed, in a direction perpendicular to the plane of the drawings. This curvature keeps the jack lightly forced towards the inside of the groove and ensures its accurate positioning and lack of vibration by keeping it properly adhering to the groove walls, by requiring the application of a certain force to move it either axially or radially.

The shank of the jack comprises in its middle part a projection 4, i.e. the upper guide butt, which comes into engagement with its own control cam 5, which urges the jack downwards when it has completed its task of pushing the needle 2.

Proceeding downwards along the jack shank there is a second butt 6 which comes into engagement with the lifting cam 7 which raises the jack together with its overlying needle, this therefore being selected to seize the yarn.

The foot of the jack comprises the lower guide butt 8. Said butt 8 cooperates with the lowerly positioned fixed cam 9. The cam 9 positions the butt 8 radially by urging it outwards so that its butt 6 engages the cam 7, which moves the jack vertically upwards. All the jacks are urged outwards by the cam 9 so that their butt 8 is engaged and they are then raised to urge their needle into its operating position.

This rocking of the jack between its inner and outer position occurs by virtue of its rotation about a pivotal centre in its upper part.

The purpose of the selection mechanism and procedure is to exclude from this totality of jacks the jacks which control those needles which in forming the particular stitch are not required to be raised.

In the known art, the mechanism for selecting or inactivating the needles consists of a plurality of levers or slides which come into contact with a plurality of butts on the lower part of the jack, in an intermediate position between 4 and 6, and which urge the jack body into the trick so preventing it making contact with the lifting cam.

The traditional selection procedure therefore consists of bringing a certain number of slides or levers into contact with a certain number of jacks 3 via the pattern butts located at the same height, by radially moving only some of the slides towards the outer surface of the cylinder. If a determined jack is to be left engaged when one or more of the slides have approached the cylinder 1, the butts corresponding to the height of those levers are removed from the jack. The number of levers or slides available for selection control is generally equal to the number of available pattern butts.

The selection procedures of the known art generally consist of producing contact between the non-removed butts of the jacks and the inactivating members, whether levers or slides, by rotating said inactivating members into a position of approach to the cylinder 1.

Obviously those inactivating members which are not required to inactivate the jacks whose butts are in a position corresponding with them are kept in the retracted position at the moment in which they would have made contact.

The devices which operate in accordance with this procedure include those of GB patent 2,147,015A of Bentley Eng. Co. and Italian patents 1,183,222 (U.S. Pat. No. 4,716,743), U.S. Ser. No. 07/335,718, filed April 10, 1989 and 1,186,475 of Officine Savio S.p.A. Needle selection by mechanical devices places very restrictive limits on the machine speed and the possible needle selection. Needle-by-needle selection at current speeds is very problematical.

The most recently proposed solutions of the known art are based on electromagnetic selection of the jacks 3 via a single pattern butt, using fixed electromagnetic selection members.

In Italian patent application No. 19918 A/88 of the present applicant Savio S.p.A. one selection member is provided in a fixed position for each feed, whereas in other patent publications such as European patent application 219029 in the name of Lonati S.p.A., GB patent application 2,008,157 in the name of Shima Center Co. Ltd., GB patent 1,436,607 (U.S. Pat. No. 3,855,819) in the name of Precision Fukuhara Works Co. Ltd. and French patent 1,564,603 in the name of Mayer & Cie the selector devices consist of a pack of electromagnetically operated selectors positioned at a point preceding each feed.

In GB patent application 2,043,712 in the name of Dainippon and others and in Swiss patent 659,673 in the name of Mozer the electromagnetic selector device is provided needle by needle, but the engineering involved is very complicated, especially for machines of high rotational speed.

The present invention is described hereinafter with reference to a typical embodiment shown in FIG. 1 by way of non-limiting example.

A main ring structure 10 surrounds both the needle cylinder 1 and the assembly of the needles 2, and rotates together with said cylinder. It can drive its motion from the cylinder and move rigidly with it, or derive its motion from other parts of the circular knitting machine.

In positions corresponding with the axial grooves in the cylinder 1, the lower part of the main ring structure 10 is provided with a number of radial grooves or slots equal to the number of needles and jacks 3 of the circular knitting machine.

The radial grooves extend substantially but not necessarily horizontally.

In the radial grooves there are located horizontal jacks 11 which can slide from an inner position in which the jack 3 is urged into its axial groove and is kept there in its rest position in which it cannot come into contact with the lifting cam 7, to an outer position in which the jack 3 is in its working position and can be raised by the action of the cam 7. For each horizontal groove a spring 12, adjustable by a screw 13, exerts an inwardly directed thrust action on its horizontal jack 11.

As the cylinder 1 rotates, all the jacks 3 encounter the cam 9 which urges them outwards while at the same time urging outwards their corresponding jacks 11, if present, and loading the springs 12.

On the main ring structure 10 in a position corresponding with each jack 11 there is located an electromagnetically operated retention device 14 which, depending on whether it is energized or unenergized, respectively retains the jack 11 in its outer position to allow the corresponding needle 2 to operate, or allows it to return to its inner position by the action of the spring 12, so inactivating the corresponding needle 2.

In the embodiment shown in FIG. 1 the device 14 consists of a ferromagnetic core provided with a winding 15 which, when traversed by a direct current, magnetizes the core 14 which then retains the jack 11 and prevents it undergoing its radial return movement.

Figure 2:
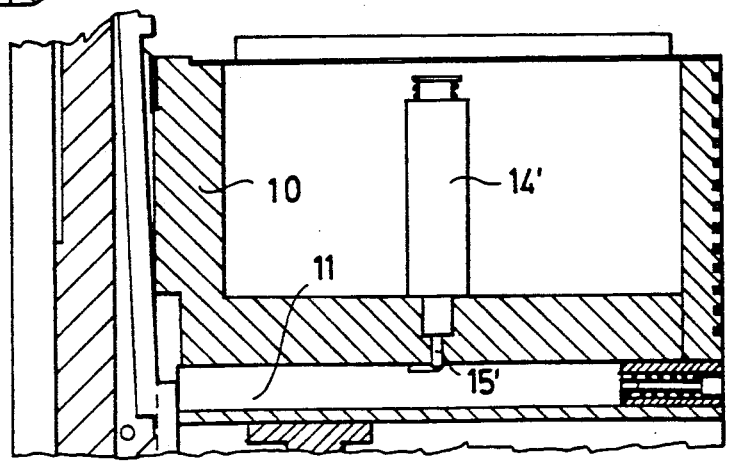
FIG. 2 is a radial section, through the needle cylinder of another embodiment of a needle selection device.

In the embodiment shown in FIG. 2, the device 14' consists of a bar 15' which depending on the polarity of the energization which it receives, assumes either a retracted position or a downwardly extended position in which it engages a corresponding notch in the jack 11, to lock it in its outer position as shown in FIG. 2. This second embodiment enables non-ferromagnetic materials to be used for the jacks 11, such as resins and composite materials. The outer cylindrical face of the ring structure 10 houses the electrical tracks 16 for transmitting the necessary electrical power for operating the electromagnets located on the main ring structure 10 which rotates rigidly with the machine cylinder. Said tracks 16 slide against brushes or other equivalent contact devices not shown on the figure.

A part of the tracks 16 and the corresponding contact devices can be dedicated to the transmission of electrical commands for needle selection.

These tracks are replaced by receiving devices if transmission is by optical, magnetic or equivalent transmission methods.

The transmission devices are fixed and located prior to the points at which the yarn is fed to the machine, by which time the needle selection must already have been made.

The top of the ring structure 10 carries the electronic components 17 and printed circuits 17' for decoding the selection command signals and operating the electromagnetic devices 14, thus implementing the electronic control of the needle selection. According to an alternative embodiment of the invention electronic control of the needle selection can be operated by an electronic instruction memory located on the ring structure 10 and rotating with the electromagnetic selection devices 14.

For completeness of illustration FIG. 1 also shows the following structural components:

18—cylinder support

19—support for the cams 20 and backing cams 21 which control the stitch formation

22—cylinder centering plate

23—thrust bearing for supporting the main ring structure 10

24—intermediate fixed plate holding the support 19

25—fixed base plate joined to 24 by a column

26—lower support ring for the cams 7 and 9.

According to a further embodiment of the present invention, for greater selection reliability the vertical jacks 3 are provided with an internal recess 27 in their lower end to house an elastic steel ring 28 which prevents the jack 3 returning inwards after it has started to rise by the action of the cam 7, so making it unnecessary to continue the energization of 14 after lifting has commenced.

The operation of the device according to the invention, as described with reference to FIG. 1, is very simple and reliable with regard to the needle selection.

By the effect of the rotation of the cylinder 1, when the foot 8 or lower butt of the jack encounters the exit cam 9, it is subjected to a radial thrust in the direction outwards from the machine axis.

During its movement it urges the horizontal jack 11, the inner part of which is in contact with it, outwards so that it loads the spring 12. If however the jack 11 has been retained in its outer position by the electromagnetic device 14, this movement does not take place because it has already happened.

The needle selection is effected successively by all those jacks 11 which are in their outer position, whether they were already occupying it or have to be moved into it.

If the electromagnetic retention member is energized (or kept energized if it was already so) the jack 3 is kept activated, whereas if it is not energized (or is de-energized if it was already energized) the jack 3 is inactivated. The needles 2 follow the same activation or inactivation selection as the underlying jacks 3.

The following two cases can therefore occur:

a) the magnet 14 is not energized (or is de-energized), the jack 3 reaches its maximum outward travel, the spring 12 releases its elastic energy and via the jack 11 returns the jack 3 to its initial position, i.e. retracted into its groove. Consequently for each machine revolution the jack 3 undergoes this movement a number of times equal to the number of cams 9;

b) the magnet 14 is energized and retains its horizontal jack 11, preventing the spring 12 from discharging its accumulated elastic energy. The corresponding vertical jack 3 is no longer urged into the cylinder groove, and remains outside it to become located in front of the lifting cam 7, which lifts it to activate the overlying needle 2.

The upper ring 5 subsequently lowers the vertical jack 3 to return it to its initial position.

As soon as the jack 3 begins to rise, its shape makes it impossible for it (at the ring 28) to return inwards if the device 14 is de-energized and the spring 12 is again able to perform its function.

The horizontal jack 11 can comprise a rectangular projection on its upper part, to make contact with the electromagnetic selector 14. If such projections are provided at different distances from its inner end and are offset between adjacent jacks, electromagnetic selection devices 14 even much thicker than the distance between two adjacent jacks can be used. In this respect it should be noted that the jacks 11 lie on the ring structure 10 just a few mm apart.

The device according to the invention has considerable advantages over the devices of the known art, of which the following should be mentioned.

The device allows needle-by-needle selection at high speeds of 1000 r.p.m. and more, on 400-needle multifeed machines. It is of limited overall height and enables the cylinder and jack height to be reduced.

The vertical jacks are much simpler and require only one pattern butt.

The electromagnetic actuation requires little energy and results in very short response times as no member has to undergo movement. The fact that the electromagnetic selector is always in a position corresponding with its jack means that the selection can be made with total reliability, rather than in the very short time available in systems of the known art in which the member to be selected rotates and the selector is fixed, the selection having to be initiated and executed within the very small space and time during which the two members correspond.

The invention can also be implemented by reversing the scheme of movement in machines in which the cylinder and main ring structure remain at rest while the cams and the triangles which move the jacks and needles rotate.

I claim:

1. A device for selecting needles in a circular knitting machine, wherein the device has a ring structure arranged about a needle cylinder and immobile with respect thereto and the cylinder has a plurality of first jacks corresponding to an equal number of needles wherein each of the first jacks are longitudinally slidable in a groove of the needle cylinder and have a single butt, and wherein the device includes a first cam ring cooperating with the first jacks for rockingly moving the first jacks radially outward into a needle selection position and the device includes a second cam ring cooperating with the first jacks for moving the first jacks longitudinally into a needle activating position said first and second cam rings being arranged around the needle cylinder so that there is a relative rotation between the needle cylinder and said first and second cam rings and wherein the device further comprises:

a) a second jack for each of the first jacks and for cooperation therewith, wherein each of said second jacks are slidable in a radial groove of sliding structure;

b) a biasing means cooperating with said second jack so that the first jack is urged radially inward into a needle inactivating position;

c) an electromagnetic device which is rigid with the ring structure for each second jack, for radially locking said second jack when said electromagnetic device is activated so that the first jack remains in the needle selection position when the corresponding needle has to knit; and d) a control means for selectively controlling activation of the electromechanical devices associated with said second jacks for needle selection.

2. The device of claim 1, wherein the ring structure is rigid with the needle cylinder.

3. The device of claim 1, wherein the ring structure and the needle cylinder rotate together and the first and second cam rings are at rest.

4. A method for selecting needles in a circular knitting machine, wherein the machine has a ring structure about a needle cylinder and is immobile with respect thereto, and the cylinder has a plurality of first jacks corresponding to an equal number of needles wherein each first jack is longitudinally slidable in a groove of the needle cylinder and wherein the machine includes a first cam ring cooperating with the first jacks for rockingly moving the first jacks into a needle selection position and a second cam ring for longitudinally moving the first jacks into a needle activating position, said first and second cam rings being arranged around the needle cylinder so that there is a relative rotation between the needle cylinder and said first and second cam rings, wherein the method comprises:

a) rockingly moving the first jacks from a needle inactivating position toward the needle selection position by means of the first cam ring;

b) radially moving respective second jacks from a first position toward a second position by said rocking movement of the first jacks;

c) loading biasing means by said movement of said second jacks to said second position;

d) selectively retaining said second jacks in said second position by selectively activating an electromagnetic device corresponding with each of said second jacks so that the respective first jacks selectively remain in the needle selection position when the corresponding needles have to knit and not retaining said second jacks in said second position by not activating said electromagnetic device so that the first jacks which correspond with needles that are not selected are moved by said biasing means back into the needle inactivating position.

5. A device for selecting needles in a circular knitting machine, wherein the device has a ring structure arranged about a needle cylinder and immobile with respect thereto and the cylinder has a first jack for each corresponding needle wherein the first jack is longitudinally slidable in a groove of the needle cylinder and has a single butt, and wherein the device includes a first cam ring cooperating with the first jacks for rockingly moving the first jacks radially outwardly into a needle selection position and the device includes a second cam ring cooperating with the first jacks for moving the first jacks longitudinally into a needle activating position, said first and second cam rings being arranged around the needle cylinder so that there is a relative rotation between the needle cylinder and said first and second cam rings and wherein the device further comprises:

a) a second jack for each of the first jacks and for cooperation therewith, wherein each of said second jack is slidable in a radial groove of said ring structure;

b) a biasing means cooperating with said second jack so that the first jack is urged radially inwards into a needle inactivating position;

c) an electromagnetic device which is rigid with the ring structure for each second jack, for radially locking said second jack when said electromagnetic device is activated so that the first a jack remains in the needle selection position when the corresponding needle has to knit;

d) a control means for selectively controlling activation of the electromagnetic devices associated with said second jacks for needle selection; and e) an elastic ring which associates with said needle cylinder, for engaging a corresponding recess in the first jacks when the first jacks are in their needle inactivating position.

6. The device of claim 5, wherein the ring structure is rigid with the needle cylinder.

7. The device of claim 5, wherein the ring structure and the needle cylinder rotate together and the first and second cam rings are at rest.

8. A method for selecting needles in a circular knitting machine, wherein the machine has a ring structure about a needle cylinder and is immobile with respect thereto, and the cylinder has a plurality of first jacks for corresponding to an equal number of needles wherein each first jack is longitudinally slidable in a groove of the needle cylinder and wherein the machine includes a first cam ring cooperating with the first jacks for rockingly moving the first jacks into a needle selection position and a second cam ring for longitudinally moving the first jacks into a needle activating position, said first and second cam rings being arranged around the needle cylinder so that there is a relative rotation between the needle cylinder and said first and second cam rings, wherein the method comprises:

a) rockingly moving the first jacks from a first position toward the needle selection position by means of the first cam ring;

b) radially moving respective second jacks from a first position toward a second position by said rocking movement of the first jacks;

c) loading biasing means by said movement of said second jacks to said second position;

d) selectively retaining said second jacks in said second position by selectively activating an electromagnetic device corresponding with each of said second jacks so that the respective first jacks selectively remain in the needle selection position when the corresponding needles have to knit and not retaining said second jacks in said second position by not activating said electromagnetic device so that the first jacks which correspond with needles that are not selected are moved by said biasing means back into the needle inactivating position; and e) engaging an elastic ring, associated with the needle cylinder, with a corresponding recess in the first jacks when the first jacks are in their needle inactivating position.

* * * * *